US009690222B2

(12) United States Patent
Hiraide

(10) Patent No.: US 9,690,222 B2
(45) Date of Patent: Jun. 27, 2017

(54) TONER, TONER CARTRIDGE, DEVELOPING UNIT, AND IMAGE FORMING APPARATUS

(71) Applicant: Oki Data Corporation, Tokyo (JP)

(72) Inventor: Manami Hiraide, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/886,513

(22) Filed: Oct. 19, 2015

(65) Prior Publication Data

US 2016/0216627 A1 Jul. 28, 2016

(30) Foreign Application Priority Data

Jan. 26, 2015 (JP) ..... 2015-012208

(51) Int. Cl.
*G03G 9/09* (2006.01)

(52) U.S. Cl.
CPC ..... *G03G 9/0926* (2013.01)

(58) Field of Classification Search
CPC ..... G03G 9/09; G03G 9/0902
See application file for complete search history.

(56) References Cited

U.S. PATENT DOCUMENTS

2010/0196817 A1* 8/2010 Sasaki ..... G03G 9/0819 430/109.4
2011/0262858 A1* 10/2011 Nair ..... G03G 9/0804 430/110.2
2012/0237868 A1* 9/2012 Yamada ..... G03G 9/0821 430/108.21

FOREIGN PATENT DOCUMENTS

JP 2012163695 A 8/2012

* cited by examiner

*Primary Examiner* — Peter Vajda
(74) *Attorney, Agent, or Firm* — Panitch Schwarze Belisario & Nadel LLP

(57) ABSTRACT

There is provided with toner including one or more kinds of brilliant pigments, and one or more kinds of coloring matters. There are also provided with a toner cartridge including the toner, a developing unit including a storing portion that stores the toner, and an image forming apparatus including a storing portion that stores the toner.

7 Claims, 7 Drawing Sheets

FIG. 7

| EXPERIMENTAL EXAMPLES | MIXTURE RATIOS(PARTS BY WEIGHT) | | | | | | |
|---|---|---|---|---|---|---|---|
| | B.L. | R.C. | Y.C. | B.R. | O.S. | R.A. | C.C. |
| 1 | 35.27 | 0.36 | 1.44 | 13.72 | 47.32 | 1.66 | 0.22 |
| 2 | 35.15 | 0.71 | 1.43 | 13.68 | 47.15 | 1.65 | 0.22 |
| 3 | 35.03 | 1.07 | 1.43 | 13.63 | 46.98 | 1.65 | 0.22 |
| 4 | 35.78 | 0.36 | 1.79 | 13.68 | 47.15 | 1.65 | 0.22 |
| 5 | 35.09 | 0.54 | 1.79 | 13.65 | 47.06 | 1.65 | 0.22 |
| 6 | 35.26 | 0.71 | 1.78 | 13.63 | 46.98 | 1.65 | 0.22 |
| 7 | 34.97 | 0.89 | 1.78 | 13.6 | 46.9 | 1.65 | 0.22 |
| 8 | 35.53 | 1.07 | 1.78 | 13.58 | 46.88 | 1.64 | 0.22 |
| 9 | 35.03 | 0.36 | 2.14 | 13.63 | 46.98 | 1.65 | 0.22 |
| 10 | 35.4 | 0.54 | 2.16 | 13.77 | 47.49 | 1.67 | 0.22 |
| 11 | 35.36 | 0.67 | 2.16 | 13.75 | 47.42 | 1.66 | 0.22 |
| 12 | 34.84 | 0.89 | 2.13 | 13.56 | 46.73 | 1.64 | 0.22 |
| 13 | 34.78 | 1.06 | 2.12 | 13.53 | 46.65 | 1.64 | 0.22 |
| 14 | 35.53 | 0.36 | 2.49 | 13.58 | 46.82 | 1.69 | 0.22 |
| 15 | 34.84 | 0.54 | 2.48 | 13.55 | 46.73 | 1.64 | 0.22 |
| 16 | 34.78 | 0.71 | 2.48 | 13.53 | 46.65 | 1.64 | 0.22 |
| 17 | 34.72 | 0.89 | 2.47 | 13.51 | 46.57 | 1.63 | 0.22 |
| 18 | 35.28 | 1.06 | 2.47 | 13.48 | 46.49 | 1.63 | 0.22 |
| 19 | 34.78 | 0.35 | 2.83 | 13.53 | 46.65 | 1.64 | 0.22 |
| 20 | 34.66 | 0.71 | 2.82 | 13.48 | 46.48 | 1.63 | 0.22 |
| 21 | 34.53 | 1.05 | 2.81 | 13.44 | 46.32 | 1.62 | 0.22 |

FIG. 8

| EXPERIMENTAL EXAMPLES | WEIGHT RATIO | | | | | EVALUATION | |
|---|---|---|---|---|---|---|---|
| | B.P. | R.C. | Y.C. | R.P. | Y.P. | IMAGE QUALITY | COLOR TONE |
| 1 | 10 | 1 | 4 | — | — | Good | 1 |
| 2 | 10 | 2 | 4 | — | — | Good | 1 |
| 3 | 10 | 3 | 4 | — | — | Good | 2 |
| 4 | 10 | 1 | 5 | — | — | Good | 1 |
| 5 | 10 | 1.5 | 5 | — | — | Good | 4 |
| 6 | 10 | 2 | 5 | — | — | Good | 5 |
| 7 | 10 | 2.5 | 5 | — | — | Good | 3 |
| 8 | 10 | 3 | 5 | — | — | Good | 2 |
| 9 | 10 | 1 | 6 | — | — | Good | 1 |
| 10 | 10 | 1.5 | 6 | — | — | Good | 4 |
| 11 | 10 | 2 | 6 | — | — | Good | 5 |
| 12 | 10 | 2.5 | 6 | — | — | Good | 3 |
| 13 | 10 | 3 | 6 | — | — | Good | 2 |
| 14 | 10 | 1 | 7 | — | — | Good | 1 |
| 15 | 10 | 1.5 | 7 | — | — | Good | 4 |
| 16 | 10 | 2 | 7 | — | — | Good | 4 |
| 17 | 10 | 2.5 | 7 | — | — | Good | 3 |
| 18 | 10 | 3 | 7 | — | — | Good | 2 |
| 19 | 10 | 1 | 8 | — | — | Good | 1 |
| 20 | 10 | 2 | 8 | — | — | Good | 2 |
| 21 | 10 | 3 | 8 | — | — | Good | 2 |
| 22 | 10 | — | — | — | — | Bad | — |

TONER, TONER CARTRIDGE, DEVELOPING UNIT, AND IMAGE FORMING APPARATUS

BACKGROUND OF THE INVENTION

1. Field of the Invention

The present invention relates to toner used for forming electrophotographic images, and a toner cartridge that uses the toner, a developing unit, and an image forming apparatus.

2. Description of the Related Art

In recent years, electrophotographic image forming apparatuses have widely spread. The reason is that high-quality images can be obtained in a short time, by comparison with image forming apparatuses of other types, such as an inkjet type.

In an electrophotographic image forming apparatus, an image is formed on a surface of a medium such as paper by using toner as a developer. In a process for forming the image, the toner is adhered to an electrostatic latent image formed on a surface of a photosensitive drum to form a toner image, the toner image is then transferred onto the surface of the medium, and thus the image is formed by using the toner.

Recently, in order to form a brilliant image, toner having brilliance has been developed. Specifically, in a case of forming a gold brilliant image, a mixture of a brilliant pigment, an azo-based yellow pigment, and a magenta pigment is used in order to obtain excellent light resistance (see Japanese Patent Application Publication No. 2012-163695 (Patent Document 1), for example).

Despite the development of the toner having the brilliance, there is still room for improvement in order to cope with demand for brilliant images.

SUMMARY OF THE INVENTION

An object of the present invention is to provide toner, a toner cartridge, a developing unit, and an image forming apparatus capable of obtaining excellent brilliant images.

According to an aspect of the present invention, toner includes: one or more kinds of brilliant pigments; and one or more kinds of coloring matters.

According to another aspect of the present invention, a toner cartridge, includes: toner; and a storing portion that stores the toner; wherein: the toner includes: one or more kinds of brilliant pigments; and one or more kinds of coloring matters.

According to another aspect of the present invention, a developing unit includes: a storing portion that stores toner; and a developing portion that performs developing processing by using the toner stored in the storing portion, wherein: the toner includes: one or more kinds of brilliant pigments; and one or more kinds of coloring matters.

According to another aspect of the present invention, an image forming apparatus, comprising: a storing portion that stores toner; a developing portion that performs developing processing by using the toner stored in the storing portion; and a transfer portion that performs transfer processing by using the toner used in the developing processing; wherein: the toner includes: one or more kinds of brilliant pigments; and one or more kinds of coloring matters.

According to the toner, the toner cartridge, the developing unit, and the image forming apparatus of the present invention, since the toner contains one or more kinds of brilliant pigments, and one or more kinds of coloring matters, the excellent brilliant image can be obtained.

BRIEF DESCRIPTION OF THE DRAWINGS

In the drawings:

FIG. 7 is a diagram showing examples of mixture ratios (parts by weight), in table form, among a brilliant dispersion liquid, a reddish-orange fluorescent coloring matter, a yellow fluorescent coloring matter, a binder resin, an organic solvent, a releasing agent and a charge control agent; and FIG. 8 is a diagram showing results of judgments by visual inspection, in table form, on image quality of brilliant images formed on surfaces of media by using the image forming apparatus in which toner of experiment examples is mounted.

DETAILED DESCRIPTION OF THE INVENTION

Figure 1:
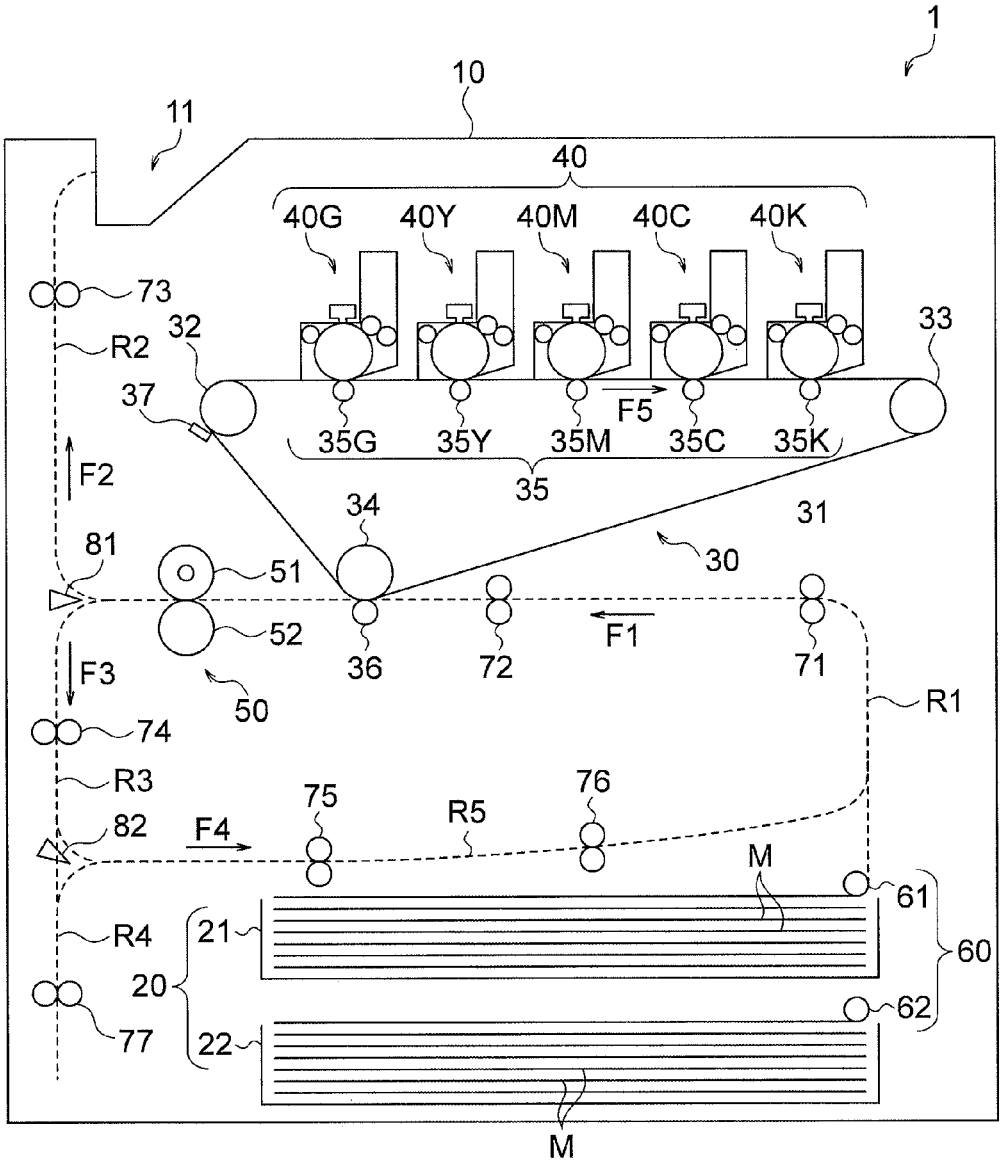
FIG. 1 is a diagram illustrating a configuration of an image forming apparatus using toner of an embodiment of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

An embodiment of the present invention will be described below in detail with reference to the accompanied drawings.

In the present application, the "brilliance" means a property of causing glitter such as luster of metals. The "brilliant pigment" means a material which has the brilliance and a property of being insoluble in an organic solvent (insolubility). Meanwhile, a "coloring matter" means a material which has a property of being colorable (colorability) and a property of being soluble in an organic solvent (solubility).

<1. Toner>

First, toner of the embodiment of the present invention will be described.

The toner which is described here is used in an electrophotographic image forming apparatus, for example. The electrophotographic image forming apparatus, for example, is a printer such as an LED (Light Emitting Diodes) printer using an LED array as an exposure light source and a laser printer using a laser light emitting element as an exposure light source. The toner used in the image forming apparatus is an electrostatic charge image developing toner.

<1-1. Constitution>

(Outline)

The toner is used for forming a brilliant image on a surface of a recording medium for image formation (hereinafter also referred to as a "medium"). Colors for the brilliant image are gold, silver, copper and the like, for example.

The toner contains one or more kinds of (at least one kind of) brilliant pigments, and one or more kinds of (at least one kind of) coloring matters (for example, dye) as coloring materials. The reason for adopting such a constitution is that excellent brilliant images can be obtained.

In detail, in a case of a use of forming a brilliant image, for the purpose of realizing the brilliance, the toner contains a brilliant pigment. In this case, if the toner contains a pigment as the coloring material, the brilliant pigment tends to aggregate with the coloring material (pigment). As the result of the brilliant pigment aggregation, the brilliance tends to deteriorate and the brilliance tends to be uneven in the brilliant image, and thus the image quality, the color tones, and the like of the brilliant image deteriorate.

On the other hand, if the toner contains the coloring matter as the coloring material, the brilliant pigment hardly aggregates with the coloring material (coloring matter). Therefore, the brilliance hardly deteriorates and the brilliance hardly becomes uneven in the brilliant image, and thus the image quality, the color tones, and the like of the brilliant image improve.

(Brilliant Pigment)

The brilliant pigment, as described above, is the material which has the property of causing glitter such as luster of metals (brilliance) and also has the property of being insoluble in an organic solvent (insolubility). For this reason, the brilliant pigment is dispersed without being solved in an organic solvent.

The toner may contain only one kind of brilliant pigment or may contain two or more kinds of brilliant pigments, as described above.

The kind of brilliant pigment is not especially limited as long as the kind of brilliant pigment is any one or more kinds of the materials having the brilliance and the insolubility. Specific examples of the brilliant pigments are aluminum (Al), a pearl pigment, and the like. The pearl pigment is a pigment which is made by covering a flake-like inorganic crystal substrate with titanium dioxide ($TiO_2$).

However, the brilliant pigment may contain an arbitrary minor component. In other words, if a case of the brilliant pigment containing aluminum is given as an example, it is sufficient that the brilliant pigment contains aluminum as a main component. That is to say, the content (purity) of aluminum in the brilliant pigment is not necessarily limited to 100%, but may be less than 100%. The reason is that the sufficient brilliance can be obtained as long as the brilliant pigment contains aluminum as the main component. It also applies to the coloring matter that the purity is not necessarily limited to 100%.

(Coloring Matter)

The coloring matter, as described above, is the material which has the property of being colorable (colorability) and the property of being soluble in an organic solvent (solubility). For this reason, unlike the brilliant pigment, the coloring matter is solved in an organic solvent.

The kinds of colors forming the brilliant image are mainly determined depending on the composition of the coloring matter contained in the toner. The composition of the coloring matter refers to the kinds of coloring matters, the combination of colors, and the like, for example.

The toner may contain only one kind of coloring matter or may contain two or more kinds of coloring matters, as described above. Although the color of the coloring matter is not especially limited, it is one or more kinds of colors such as yellow, red (magenta), blue (cyan), black, a transparent color (clear), and the like, for example. If the kinds of coloring matters are two or more kinds, the colors of the coloring matters may be the same, or may be different from one another. Some of the two or more kinds of coloring matters may be the same in color.

The kinds of coloring matters are not especially limited as long as they are any one or more kinds of the materials each having the coloring property and the solubility. Specific examples of the yellow coloring matter are C.I. pigment yellow 74, a cadmium yellow, and the like. Specific examples of the red coloring matter are C.I. pigment red 238, and the like. Specific examples of the blue coloring matter are pigment blue 15:3, and the like. Specific examples of the black coloring matter are carbon black, and the like, and the carbon black is, for example, furnace black, channel black, and the like. Specific examples of the coloring matter in transparent color are a fluorescent brightening agent, and the like.

(Composition)

The composition of the toner is not especially limited as long as the toner contains one or more kinds of brilliant pigments, and one or more kinds of coloring matters. The composition which will be described here is, for example: (1) the kinds and number of brilliant pigments; (2) the kinds and number of coloring matters; (3) colors of the coloring matters and a combination of the colors; (4) the content of the brilliant pigment; (5) the content of the coloring matter; and (6) a mixture ratio between the coloring matter and the brilliant pigment, and the like.

Here, an example of the composition of the toner used for forming a gold brilliant image will be given below.

The toner, for example, contains one or more kinds of brilliant pigments, and contains two kinds of coloring matters (a reddish-orange fluorescent coloring matter and a yellow fluorescent coloring matter). The brilliant pigment, for example, contains aluminum and the like. The respective kinds of the reddish-orange fluorescent coloring matter and the yellow fluorescent coloring matter are not especially limited.

In this case, the mixture ratio among the brilliant pigment, the reddish-orange fluorescent coloring matter, and the yellow fluorescent coloring matter is not especially limited. As described above, the reason is that the toner contains the coloring matters (the reddish-orange fluorescent coloring matter and the yellow fluorescent coloring matter) as the coloring materials together with the brilliant pigment, and thus the image quality, the color tone, and the like of the brilliant image are improved.

A ratio of a weight of the reddish-orange fluorescent coloring matter to a weight of the brilliant pigment is preferable to be in a range of 1.5 to 2.5 (that is, not less than 1.5 and not more than 2.5), and is more preferable to be in a range of 1.5 to 2.0 (that is, not less than 1.5 and not more than 2.0) when the weight of the brilliant pigment is 10. The reason is that the mixture ratio of the reddish-orange fluorescent coloring matter to the brilliant pigment is optimized, and thus the sufficient brilliance can be obtained while the color tone of the reddish-orange color is ensured.

In addition, a ratio of the weight of the yellow fluorescent coloring matter to the weight of the brilliant pigment is preferable to be in a range of 5 to 7 (that is, not less than 5 and not more than 7), and is more preferable to be in a range of 5 to 6 (that is, not less than 5 and not more than 6) when the weight of the brilliant pigment is 10. The reason is that the mixture ratio of the yellow fluorescent coloring matter to the brilliant pigment is optimized, and thus the sufficient brilliance can be obtained while the color tone of the yellow color is ensured.

In order to specify the ratio of the weight of the reddish-orange fluorescent coloring matter to the weight of the brilliant pigment, for example, it is sufficient to measure the ratio of the weight of the brilliant pigment and the ratio of the weight of the reddish-orange fluorescent coloring matter contained in the toner, and to then calculate the ratio of the weight of the reddish-orange fluorescent coloring matter to the weight of the brilliant pigment. A method of measuring the weight of the brilliant pigment and the weight of the reddish-orange fluorescent coloring matter contained in the toner, for example, is as follows.

When the weight of the brilliant pigment is measured, the toner is dissolved by using an organic solvent such as toluene. The toner is accordingly separated into the brilliant pigment as an insoluble component, and a mixture as a soluble component. In this mixture, the reddish-orange fluorescent coloring matter and the yellow fluorescent coloring matter are dissolved by the organic solvent. The brilliant pigment as the insoluble component is weighed to obtain the weight of the brilliant pigment.

When the weight of the reddish-orange fluorescent coloring matter is measured, the toner is weighed, and then the toner is dissolved by using the organic solvent, by following the procedure similar to that for measuring the weight of the brilliant pigment. A mixture containing the reddish-orange fluorescent coloring matter is accordingly obtained. After an ultraviolet-visible absorption spectrum of the resultant mixture is measured, a concentration of the reddish-orange fluorescent coloring matter in the resultant mixture is obtained according to the Lambert-Beer law. Thus, the weight of the reddish-orange fluorescent coloring matter is obtained.

The resultant mixture which is used for measuring the ultraviolet-visible absorption spectrum contains the yellow fluorescent coloring matter together with the reddish-orange fluorescent coloring matter. However, since a wavelength of the absorption spectrum of the reddish-orange fluorescent coloring matter and a wavelength of the absorption spectrum of the yellow fluorescent coloring matter are different from each other, even when both the reddish-orange fluorescent coloring matter and the yellow fluorescent coloring matter are contained in the resultant mixture, it is possible to distinguish the absorption spectrum of the reddish-orange fluorescent coloring matter and the absorption spectrum of the yellow fluorescent coloring matter from each other. Therefore, even when the mixture is used as described above, the concentration of the reddish-orange fluorescent coloring matter can be obtained, and the weight of the reddish-orange fluorescent coloring matter can be obtained on the basis of the obtained concentration.

In order to measure the ratio of the weight of the yellow fluorescent coloring matter to the weight of the brilliant pigment, for example, a method similar to the method of measuring the ratio of the weight of the reddish-orange fluorescent coloring matter to the weight of the brilliant pigment may be used, except for obtaining the weight of the yellow fluorescent coloring matter instead of the weight of the reddish-orange fluorescent coloring matter.

The content of the brilliant pigment in the toner is not especially limited. The reason is that, as described above, the toner contains the coloring matters (the reddish-orange fluorescent coloring matter and the yellow fluorescent coloring matter) as the coloring materials together with the brilliant pigment, and thus the image quality, the color tone, and the like of the brilliant image are improved.

It is preferable that the content of the brilliant pigment in the toner be in a range of 15 wt % to 20 wt % (that is, not less than 15 wt % and not more than 20 wt %). The reason is that the content of the brilliant pigment is optimized, and thus it is possible to obtain the sufficient brilliance while suppressing the aggregation among the brilliant pigments, and the like.

In order to measure the content of the brilliant pigment in the toner, for example, the toner is weighed, and then the weight of the brilliant pigment is obtained by following the procedure described above. Accordingly, the weight of the toner and the weight of the brilliant pigment are specified, and thus the content of the brilliant pigment in the toner is obtained.

(Other Materials)

In addition, the toner may contain any one or more kinds of other materials in addition to one or more kinds of brilliant pigments, and one or more kinds of coloring matters. The kinds and contents of the other materials are not especially limited.

The toner manufactured by using a dissolution suspension method which will be described below, for example, contains granulated products formed by mixing an oil phase and a water phase with each other. Although a composition of the oil phase is not especially limited, the oil phase contains one or more kinds of brilliant pigments, one or more kinds of coloring matters, a binder resin, and an organic solvent, for example. However, the oil phase further contains a releasing agent, a charge control agent, and so on, in some cases. Although a composition of the water phase is not especially limited, the water phase contains an inorganic dispersion agent and an aqueous medium, for example.

Thus, the toner manufactured by using the dissolution suspension method, for example, contains the binder resin and the like as other materials. However, the toner further contains the releasing agent, the charge control agent, and so on mentioned above in some cases. The details of the binder resin, the releasing agent, and the charge control agent will be described later.

<1-2. Manufacturing Method>

A method of manufacturing the toner is not especially limited. That is to say, the toner, for example, may be manufactured by using a grinding method, may be manufactured by using the dissolution suspension method, or may be manufactured by using any method other than these methods. The toner may be manufactured by using two or more kinds of manufacturing methods out of the manufacturing methods mentioned above.

It is preferable that the toner be manufactured by using the dissolution suspension method. The reason is that it allows outstanding particle-size control, and thus the toner having a desired particle size can be manufactured with ease and high accuracy.

When the toner is manufactured by using the dissolution suspension method, the oil phase and the water phase are mainly prepared, and then the oil phase and the water phase are mixed with each other to obtain granulated products. The details of the procedure for manufacturing the toner by using the dissolution suspension method, for example, will be described as follows.

(Preparation of Oil Phase)

When the oil phase is prepared, first, a polymeric dispersion agent having a basic functional group is dissolved in an organic solvent to obtain a dispersion agent solution.

Although the kind of organic solvent is not especially limited, for example, the kind of organic solvent is any one or more kinds out of ester, hydrocarbon, hydrocarbon halide, alcohol, ketone, and the like. Specific examples of ester are methyl acetate, ethyl acetate, butyl acetate, and the like. Specific examples of hydrocarbon are toluene, xylene, and the like. Specific examples of hydrocarbon halide are methylene chloride, chloroform, dichloroethane, and the like. Specific examples of alcohol are methanol, ethanol, and the like. Specific examples of ketone are acetone, methyl ethyl ketone, cyclohexanone, and the like. The details of the organic solvents described here also apply to the organic solvents which will be described below.

The kind of polymeric dispersion agent is not especially limited.

Next, a brilliant pigment is dispersed into the dispersion agent solution to obtain a brilliant dispersion liquid. The kind of brilliant pigment may be only one kind, or may be two or more kinds.

Next, a coloring matter and a binder resin are dissolved in the brilliant dispersion liquid to obtain a brilliant-coloring-matter-containing liquid. The kind of coloring matter may be only one kind, or may be two or more kinds. In addition, when the coloring matter or the like is added to the brilliant dispersion liquid, the brilliant dispersion liquid may be heated or stirred.

The binder resin (also referred to as "binder"), for example, is any one or more kinds of polymer materials such as polyester, polyethylene, polypropylene, and the like.

The binder resin is preferable to be polyester. The reason is that a surface of a brilliant image (a toner image which will be described later) is easily smoothed, and thus the brilliance hardly deteriorates and the brilliance hardly becomes uneven. The polyester, for example, is a reactant (condensation polymer) of one or more kinds of alcohols and one or more kinds of carboxylic acids.

Although the kind of alcohol is not especially limited, in particular, it is preferable to be a dihydric or polyhydric alcohol or a derivative thereof. Specific examples of the dihydric or polyhydric alcohol is ethylene glycol, diethylene glycol, triethylene glycol, polyethylene glycol, propylene glycol, butanediol, pentanediol, hexanediol, cyclohexane dimethanol, xylene glycol, dipropylene glycol, polypropylene glycol, bisphenol A, hydrogenated bisphenol A, bisphenol A ethylene oxide, bisphenol A propylene oxide, sorbitol, glycerin, and the like.

Although the kind of carboxylic acid is not especially limited, it is preferable to be dicarboxylic or polycarboxylic acid, or a derivative thereof. Specific examples of dicarboxylic or polycarboxylic acid are maleic acid, fumaric acid, phthalic acid, isophthalic acid, terephthalic acid, succinic acid, adipic acid, trimellitic acid, pyromellitic acid, cyclopentanedicarboxylic acid, succinic anhydride, trimellitic anhydride, maleic anhydride, dodecenylsuccinic anhydride, and the like.

Finally, by adding the organic solvent, the releasing agent, and the charge control agent to the brilliant-coloring-matter-containing liquid, the oil phase is obtained. In addition, when the organic solvent is added to the brilliant-coloring-matter-containing liquid, the organic solvent may be heated in advance.

The releasing agent is used to improve the fixing property and offset resistance property of the toner. The releasing agent, for example, is any one or more kinds out of petroleum wax, synthetic wax, and other wax. Specific examples of petroleum wax are paraffin wax, oxidized paraffin wax, and the like. Specific examples of synthetic wax are polyolefin wax, oxidized polyolefin wax, and the like. Specific examples of the other wax are ester wax, ether wax, and the like, and the other wax may be animal-derived wax, plant-derived wax, and the like.

The kind of charge control agent is not especially limited.

(Preparation of Water Phase)

In the case of preparing the water phase, an inorganic dispersion agent (suspension stabilizer) or the like is dispersed into or dissolved in an aqueous medium.

The aqueous medium, for example, is any one or more kinds out of pure water and the like. The aqueous medium may be a mixture of pure water and a water-soluble solvent, for example.

The inorganic dispersion agent, for example, is any one or more kinds of inorganic materials such as tricalcium phosphate, hydroxyapatite, calcium carbonate, titanium oxide, aluminum hydroxide, magnesium hydroxide, barium sulfate, silica and the like. The silica, for example, is silicon dioxide or the like.

(Granulation)

After the water phase is mixed with the oil phase, a resultant mixture is stirred. A mixture ratio between the oil phase and the water phase is not especially limited. Accordingly, the mixture suspends and granulation occurs, and thus a slurry containing precursor particles is obtained.

Then, the slurry is distillated at a reduced pressure, and the organic solvent is volatilized and removed. Then, a pH regulator is added to the slurry, the slurry is then stirred, and the inorganic dispersion agent is removed by dissolution. The pH regulator, for example, is any one or more kinds of acids such as nitric acid. Then, the slurry is dehydrated to collect the precursor particles, and then the precursor particles are washed. In this case, for example, the precursor particles are re-dispersed into the pure water, and then the pure water is stirred. Then, the precursor particles are dehydrated and dried, and then the precursor particles are classified.

Finally, the precursor particles are mixed with hydrophobic particles, and then a resultant mixture is stirred. A mixture ratio between the hydrophobic particles and the precursor particles is not especially limited. Accordingly, the hydrophobic particles are fixed on the surfaces of the precursor particles, and thus the toner is obtained.

<1-3. Function and Effect>

The toner contains one or more kinds of brilliant pigments, and one or more brilliant kinds of coloring matters as the coloring materials. In this case, as described above, in comparison with the case where a pigment is used as the coloring material, the brilliant pigment hardly aggregates, and thus the brilliance hardly deteriorates and the brilliance hardly becomes uneven. Therefore, the image quality, the color tone, and the like of the brilliant image improve, and thus the excellent brilliant image can be obtained. In this case, by changing the mixture ratio between the coloring matter and the brilliant pigment, and the like, the color tone of the brilliant image can be adjusted so as to be a desired color tone.

In particular, when the toner is manufactured by using the dissolution suspension method, as described above, since the toner having the desired particle size is manufactured with ease and high accuracy, the effect can be improved.

Moreover, when the coloring matter contains the reddish-orange fluorescent coloring matter and the yellow fluorescent coloring matter, excellent gold brilliant images can be obtained. In this case, if the ratio of the weight of the reddish-orange fluorescent coloring matter to the weight of the brilliant pigment is in the range of 1.5 to 2.5 when the weight of the brilliant pigment is 10, and the ratio of the weight of the yellow fluorescent coloring matter to the weight of the brilliant pigment is in the range of 5 to 7 when the weight of the brilliant pigment is 10, the effect can be improved. Moreover, when the content of the brilliant pigment in the toner is in the range of 15 wt % to 20 wt %, the effect can be improved.

<2. Image Forming Apparatus>

Next, an image forming apparatus using the toner described above will be described. Since a toner cartridge and a developing unit of the embodiment of the present invention constitute part of the image forming apparatus which will now be described, the toner cartridge and the developing unit of the embodiment of the present invention will be also described below.

<2-1. Whole Configuration>

First, a configuration of the image forming apparatus will be described.

Figure 2:
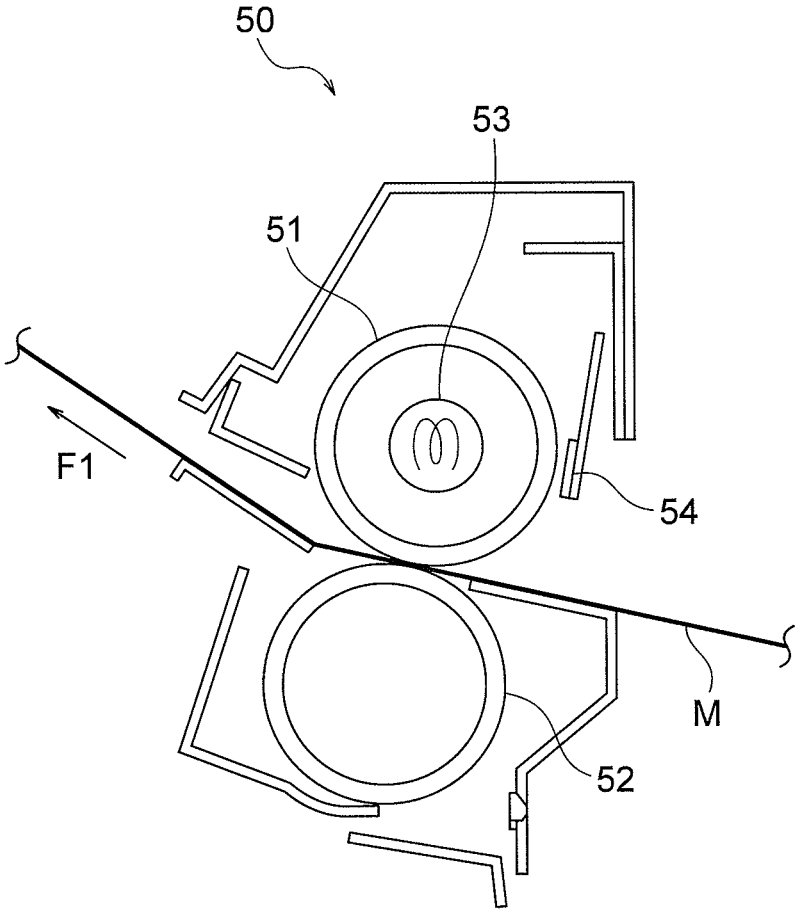
FIG. 2 is a diagram illustrating an enlarged view of a configuration of a part (fixing portion) of the image forming apparatus illustrated in FIG. 1.

FIG. 1 illustrates a configuration of an image forming apparatus 1. FIG. 2 illustrates an enlarged view of a configuration of part (fixing portion 50) of the image forming apparatus 1 illustrated in FIG. 1.

The image forming apparatus 1 which will be described here is an electrophotographic full-color printer, and forms a brilliant image on a surface of a medium M. The medium M, for example, is any one or more kinds out of paper, a film, and the like, and a material of the medium M is not especially limited. FIG. 1 illustrates a state in which no medium M is conveyed, and FIG. 2 illustrates a state in which the medium M is conveyed.

The image forming apparatus 1, for example, includes one or more trays 20, a transfer portion 30, one or more developing units 40 (also referred to as "image forming units"), a fixing portion 50, one or more feeding rollers 60, conveyance rollers 71 to 77, and conveyance path switching guides 81 and 82, inside a case 10. A stacker portion 11 for discharging therefrom the medium M on which a brilliant image is formed is provided in the case 10. Broken lines R1 to R5 represent a conveyance path for the medium M.

The tray 20 stores therein the medium M and is detachably mounted to the case 10, for example. Inside the tray 20, a plurality of media M are stored in a state of being stacked, for example. The plurality of media M are taken out one by one from the tray 20 by the feeding roller 60.

Here, for example, the image forming apparatus 1 includes the two trays 20 (21, 22), and the two feeding rollers 60 (61, 62). The trays 21 and 22, for example, are disposed so as to be stacked with each other.

The transfer portion 30 includes an intermediate transfer belt 31, a driving roller 32, a driven roller (idle roller) 33, a backup roller 34, one or more primary transfer rollers 35, a secondary transfer roller 36, and a cleaning blade 37.

The intermediate transfer belt 31 is an intermediate transfer medium onto which a toner image is temporarily transferred before the toner image is transferred onto the surface of the medium M. The intermediate transfer belt 31, for example, is an endless elastic belt containing a polymer material such as polyimide. The intermediate transfer belt 31 can be moved clockwise by utilizing a rotational force of the driving roller 32 in a state in which the intermediate transfer belt 31 is supported and stretched by the driving roller 32, the driven roller 33, and the backup roller 34.

The driving roller 32 can be rotated clockwise through a driving source such as a motor. Each of the driven roller 33 and the backup roller 34 can be rotated clockwise like the driving roller 32, by utilizing the rotational force of the driving roller 32.

The primary transfer roller 35 transfers (primary transfer) the toner image formed by the developing unit 40 onto the intermedium transfer belt 31. The primary transfer roller 35 is pressed against the developing unit 40 (a photosensitive drum 411 which will be described later) through the intermedium transfer belt 31. The primary transfer roller 35 can be rotated clockwise in accordance with a movement of the intermedium transfer belt 31.

Here, for example, the transfer portion 30 includes five primary transfer rollers 35 (35G, 35Y, 35M, 35C, and 35K) corresponding to five developing units 40 (40G, 40Y, 40M, 40C, and 40K) which will be described later, respectively.

The secondary transfer roller 36 transfers (secondary transfer) the toner image transferred onto the surface of the intermediate transfer belt 31, to the surface of the medium M. The secondary transfer roller 36 is pressed against the backup roller 34 and, for example, includes a core material made of metal, and an elastic layer such as a foam rubber layer covering the outer peripheral surface of the core material. The secondary transfer roller 36 can be rotated counterclockwise in accordance with the movement of the intermediate transfer belt 31.

The cleaning blade 37 scrapes unnecessary toner remaining on the surface of the intermedium transfer belt 31.

In order to form the toner image, the developing unit 40 forms an electrostatic latent image and causes the toner to adhere to the electrostatic latent image by utilizing the Coulomb's force. In this case, for example, the image forming apparatus 1 includes the five developing units 40 (40G, 40Y, 40M, 40C, and 40K). The developing units 40G, 40Y, 40M, 40C, and 40K perform development processing, for example, by using toners 43G, 43Y, 43M, 43C, and 43K (see FIG. 3 to FIG. 5) which will be described later, respectively.

The developing units 40G, 40Y, 40M, 40C, and 40K are each detachably mounted to the case 10, and are arranged along a movement path of the intermediate transfer belt 31. In this case, for example, the developing units 40G, 40Y, 40M, 40C, and 40K are disposed from the upstream side (the side near the driving roller 32) toward the downstream side (the side near the driven roller 33) in this order, in a movement direction of the intermediate transfer belt 31.

The toners 43G, 43Y, 43M, 43C, and 43K are stored in the developing units 40G, 40Y, 40M, 40C, and 40K, respectively. In this case, for example, the toners 43G, 43Y, 43M, 43C, and 43K which are different in color from one another are stored in the developing units 40G, 40Y, 40M, 40C, and 40K, respectively. Specifically, the gold toner 43G, for example, is stored in the developing unit 40G. The yellow toner 43Y, for example, is stored in the developing unit 40Y. The red (magenta) toner 43M, for example, is stored in the developing unit 40M. The blue (cyan) toner 43C, for example, is stored in the developing unit 40C. The black toner 43K, for example, is stored in the developing unit 40K.

Details of the configuration of each of the developing units 40G, 40Y, 40M, 40C, and 40K will be described later.

The fixing portion 50 fixes the toner image onto the surface of the medium M through a pressure treatment and a heat treatment. The fixing portion 50, for example, includes a heating roller 51, a pressure roller 52, a heater 53, and a thermistor 54.

The heating roller 51, for example, includes a hollow cylindrical core metal, a heat-resistant elastic layer with which the outer peripheral surface of the core metal is covered, and a resin tube with which the outer peripheral surface of the heat-resistant elastic layer is covered. The core metal, for example, contains a metallic material such as aluminum. The heat-resistant elastic layer, for example, contains a polymer material such as a silicon rubber. The resin tube, for example, contains a copolymer of tetrafluorethylene and perfluoroalkyl vinyl ether (PFA), and the like. The heating roller 51 can be rotated clockwise through a driving source such as a motor.

The pressure roller 52, for example, has a configuration which is the same as that of the heating roller 51. The pressure roller 52 is pressed against the heating roller 51, and can be rotated counterclockwise in accordance with rotation of the heating roller 51.

The heater 53 is installed inside the heating roller 51 (core metal) and, for example, is a halogen lamp or the like.

The thermistor 54 is disposed in a position apart from the heating roller 51, and detects a surface temperature of the heating roller 51. The information on the temperature detected by the thermistor 54, for example, is utilized for temperature control for the image forming apparatus 1, and the like. Since an operation (ON/OFF) of the heater 53 is controlled on the basis of the information on the temperature detected by the thermistor 54, the surface temperature of the heating roller 51 is controlled.

The conveyance rollers 71 to 77 convey the medium M taken out by the feeding roller 60 in the inside of the case 10. When the brilliant image is formed on only one side of the medium M, for example, the medium M is conveyed by the conveyance rollers 71 to 73 along the conveyance paths R1 and R2. When the brilliant image is formed on the both sides of the medium M, for example, the medium M is conveyed by the conveyance rollers 71 to 77 along the conveyance paths R1 to R5. Details of the conveyance paths for the medium M will be described later.

The conveyance switching guides 81 and 82 switch the conveyance direction of the medium M depending on conditions such as whether the brilliant image is formed on only one side of the medium M, or the brilliant image is formed on the both sides of the medium M, and so forth.

<2-2. Configuration of Developing Unit>

Figure 3:
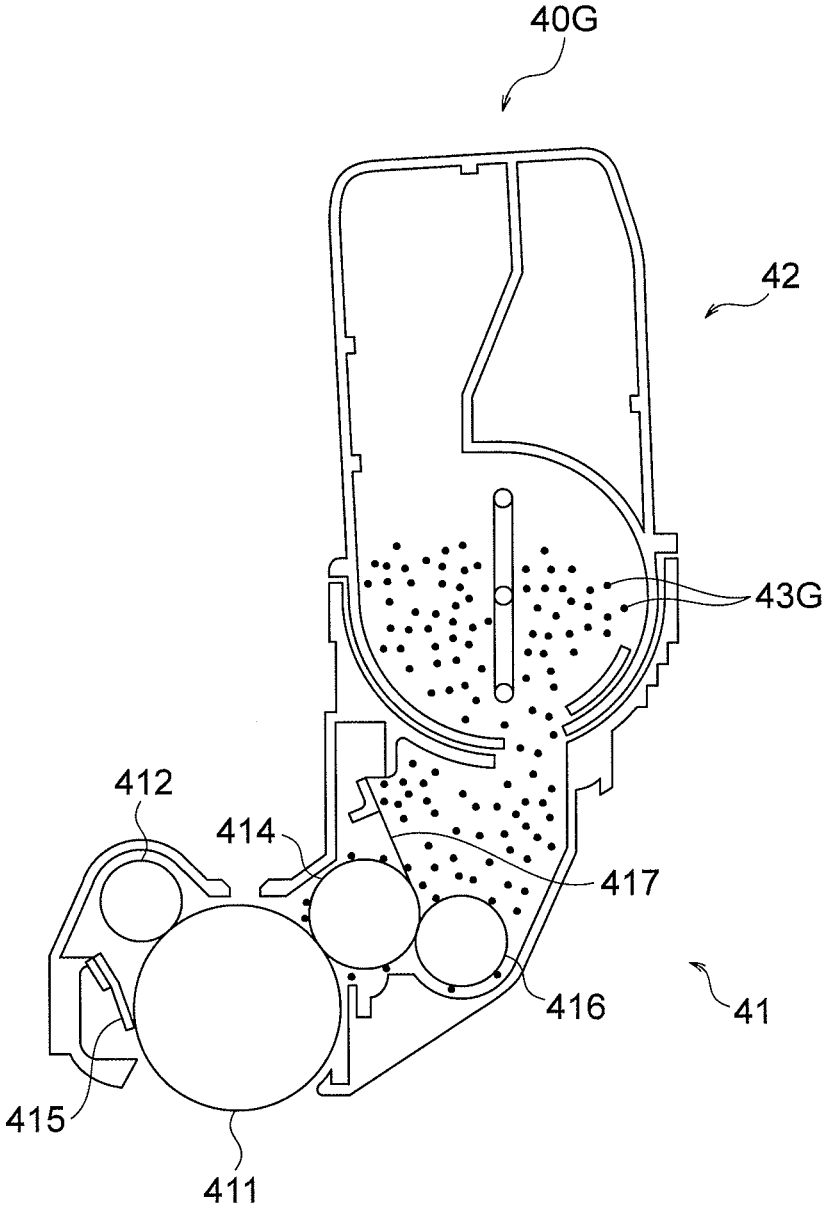
FIG. 3 is a diagram illustrating an enlarged view of a configuration of a developing unit illustrated in FIG. 1.
Figure 4:
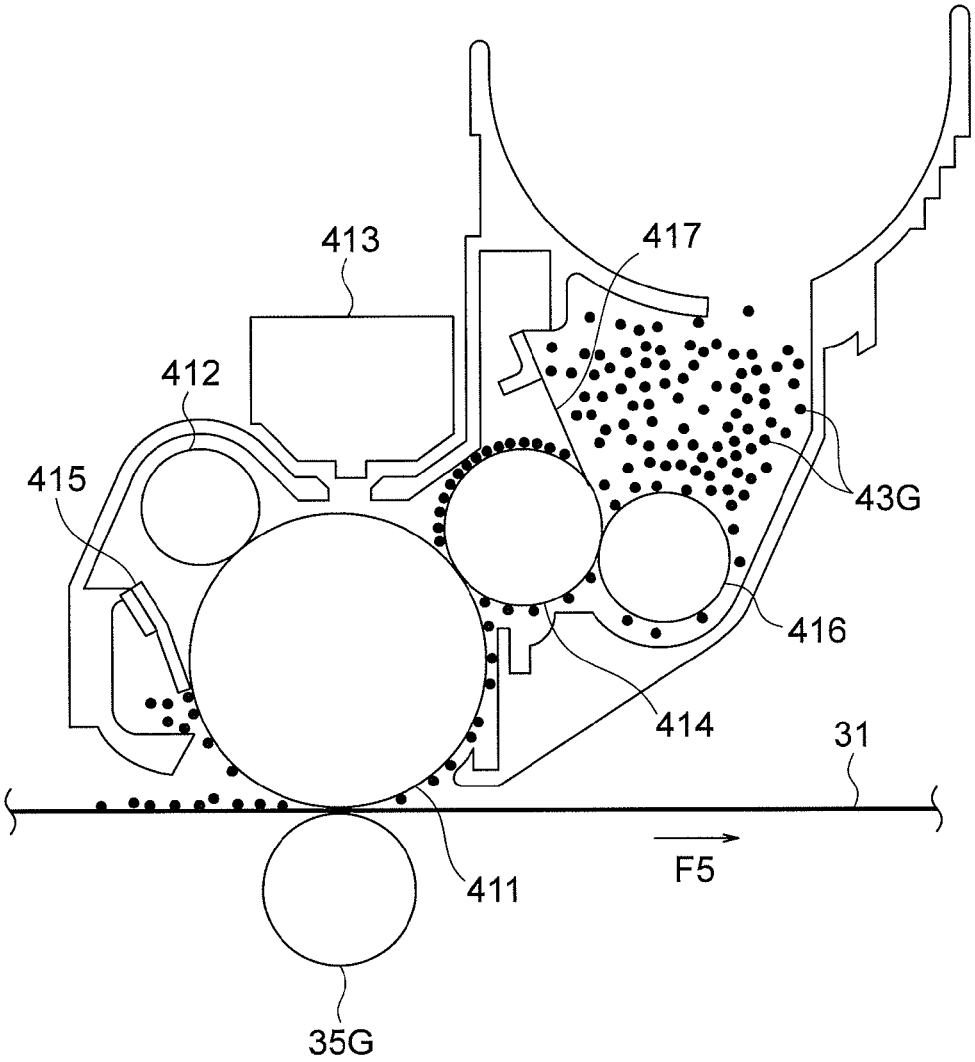
FIG. 4 is a diagram illustrating an enlarged view of a configuration of part of the image forming apparatus illustrated in FIG. 1.

FIG. 3 illustrates an enlarged view of the configuration of the developing units 40G illustrated in FIG. 1. Since the respective developing units 40G, 40Y, 40M, 40C, and 40K have the same internal structure with each other, FIG. 3 shows the developing units 40G as a representative example. FIG. 4 illustrates an enlarged view of a configuration of part of the image forming apparatus 1 illustrated in FIG. 1 and FIG. 3.

The developing units 40G, 40Y, 40M, 40C, and 40K have the same configuration except that the kinds of toners 43G, 43Y, 43M, 43C, and 43K which are stored in the toner cartridge 42 are different from one another.

The developing unit 40G, for example, includes a developing portion 41 and a toner cartridge 42.

The developing portion 41, for example, includes a photosensitive drum 411, a charging roller 412, a light emitting diode (LED) head 413, a developing roller 414, a cleaning blade 415, a supply roller 416, and a developing blade 417.

The photosensitive drum 411, for example, is an organic photosensitive body which includes a cylindrical conductive supporting body, and a photoconductive layer with which the outer peripheral surface of the conductive supporting body is covered, and the photosensitive drum 411 can be rotated counterclockwise through a driving source such as a motor. The conductive supporting body, for example, is a metallic pipe containing a metallic material such as aluminum. The photoconductive layer, for example, is a laminated body including a charge generating layer, a charge transferring layer, and the like.

The charging roller 412, for example, includes a metallic shaft, and a semiconductive epichlorohydrin rubber layer with which the outer peripheral surface of the metallic shaft is covered, and the charging roller 412 can be rotated clockwise. In order to charge the surface of the photosensitive drum 411 with electricity, the charging roller 412 is pressed against the photosensitive drum 411.

The LED head 413 is an exposure device which exposes the surface of the photosensitive drum 411 to form an electrostatic latent image on the surface of the photosensitive drum 411 and, for example, includes an LED element, a lens array, and the like. The LED element and the lens array are disposed in such a way that light (irradiation light) emitted from the LED element forms images on the surface of the photosensitive drum 411.

The developing roller 414, for example, includes a metallic shaft, and a semiconductive urethane rubber layer with which the outer peripheral surface of the metallic shaft is covered, and the developing roller 414 can be rotated clockwise. The developing roller 414 carries thereon the toner 43G supplied thereto from the supply roller 416, and also causes the toner 43G to adhere to the electrostatic latent image formed on the surface of the photosensitive drum 411.

The cleaning blade 415 scrapes the unnecessary toner 43G remaining on the surface of the photosensitive drum 411. The cleaning blade 415, for example, extends in a direction crossing the paper (in a direction substantially parallel with an axis of rotation of the photosensitive drum 411) in FIG. 3 and FIG. 4, and is pressed against the photosensitive drum 411. In addition, the cleaning blade 415, for example, contains therein a polymer material such as an urethane rubber.

The supply roller 416, for example, includes a metallic shaft, and a semiconductive foam silicon sponge layer with which the outer peripheral surface of the metallic shaft is covered, and the supply roller 416 can be rotated counterclockwise. The supply roller 416 supplies the toner 43G to the surface of the photosensitive drum 411 while slidingly contacting with the developing roller 414.

The developing blade 417 regulates a thickness of the toner 43G supplied to the surface of the supply roller 416. The developing blade 417 is disposed at a predetermined distance from the developing roller 414, and the thickness of the toner 43G is controlled on the basis of the predetermined distance. In addition, the developing blade 417 can be formed, for example, of a metallic material such as stainless steel.

The toner cartridge 42, for example, is detachably mounted to the developing portion 41, and stores therein the toner 43G as a developer. The toner 43G has a constitution which is the same as that of the above-described toner of the embodiment of the present invention, and is used for forming a brilliant image.

The configuration of the developing units 40Y, 40M, 40C, and 40K, for example, is the same as that of the developing unit 40G except that the toners 43Y, 43M, 43C, and 43K are stored in the respective toner cartridges 42, as described above. That is to say, in the developing unit 40Y, the yellow toner 43Y is stored in the toner cartridge 42. In the developing unit 40M, the red toner 43M is stored in the toner cartridge 42. In the developing unit 40C, the blue toner 43C is stored in the toner cartridge 42. In the developing unit 40K, the black toner 43K is stored in the toner cartridge 42.

<2-3. Configuration of Toner Cartridge>

Figure 5:
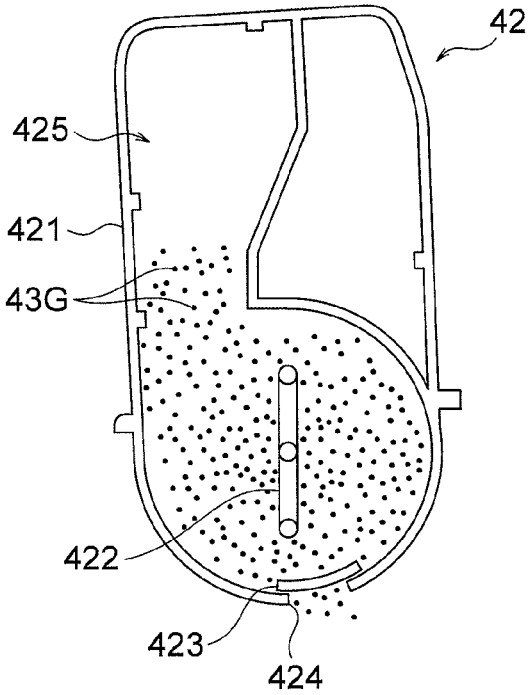
FIG. 5 is a diagram illustrating an enlarged view of a configuration of part (toner cartridge) of the developing unit illustrated in FIG. 3.

FIG. 5 illustrates an enlarged view of a configuration of part (the toner cartridge 42) of the developing units 40G illustrated in FIG. 3.

The toner cartridges 42 which are applied to the respective developing units 40G, 40Y, 40M, 40C, and 40K have the same configuration except that the kinds of toners 43G, 43Y, 43M, 43C, and 43K which are stored in storing portions 425 are different from one another. For this reason, FIG. 5 illustrates the toner cartridges 42 which are applied to the developing units 40G.

The toner cartridge 42 applied to the developing unit 40G, for example, stores the toner 43G inside a cartridge main body 421 (the storing portion 425), and includes a stirring bar 422 in the storing portion 425. The toner cartridge 42, for example, extends in the direction crossing the paper in FIG. 5.

A discharge opening 424 for discharging the toner 43G is provided in the cartridge main body 421. The toner 43G is supplied from the toner cartridge 42 to the supply roller 416 (see FIG. 4). The discharge opening 424, for example, is provided with a shutter 423 which can be opened and closed by utilizing a slide mechanism.

The inside of the cartridge main body 421 is divided into a plurality of regions. One of the plurality of regions is the storing portion 425 in which the toner 43G is stored.

The stirring bar 422, for example, extends in the direction crossing the paper in FIG. 5 similarly to the toner cartridge 42. The stirring bar 422 which is rotatable about an axis of rotation stirs the toner 43G stored in the storing portion 425.

The configuration of the toner cartridges 42 which are applied to the respective developing units 40Y, 40M, 40C, and 40K, for example, is the same as that of the toner cartridge 42 which is applied to the developing unit 40G except that the kinds of toners 43Y, 43M, 43C, and 43K which are stored in the storing portions 425 are different from one another, as described above.

<2-4. Operation>

Next, the operation of the image forming apparatus 1 will be described with reference to FIG. 1 to FIG. 5.

The image forming apparatus 1, for example, forms the brilliant image on the surface of the medium M while performing developing processing, primary transfer processing, secondary transfer processing, fixing processing, and cleaning processing which will be described below. A case where, for example, the medium M stored in the tray 21 is used will be described below.

<Developing Processing>

The medium M stored in the tray 21 is conveyed in a direction indicated by an arrow F1 along the conveyance path R1 by the conveyance rollers 71 and 72. In this case, a plurality of media M stored in the tray 21 are taken out one by one by the feeding roller 61.

In the developing processing, in the developing portion 41 of the developing unit 40G, when the photosensitive drum 411 rotates, the charging roller 412 applies a D.C. voltage to the surface of the photosensitive drum 411 while rotating. This D.C. voltage, for example, is supplied from a high-voltage power source to the charging roller 412. Accordingly, the surface of the photosensitive drum 411 is uniformly charged with electricity.

Then, the LED head 413 irradiates the surface of the photosensitive drum 411 with light in accordance with an image signal. Accordingly, a surface electric potential is attenuated (light attenuation) in a portion irradiated with the light on the surface of the photosensitive drum 411, and thus an electrostatic latent image is formed on the surface of the photosensitive drum 411.

Meanwhile, in the toner cartridge 42 of the developing unit 40G, the shutter 423 slides, and then the toner 43G stored in the storing portion 425 is discharged to the supply roller 416 through the discharge opening 424.

When a voltage is applied to the supply roller 416, the supply roller 416 rotates. This voltage, for example, is supplied from the high-voltage power source to the supply roller 416. Accordingly, the toner 43G is supplied from the toner cartridge 42 to the surface of the supply roller 416.

When a voltage is applied to the developing roller 414, the developing roller 414 rotates while being pressed against the supply roller 416. This voltage, for example, is supplied from the high-voltage power source to the developing roller 414. Accordingly, the toner 43G which has been supplied to the surface of the supply roller 416 is adhered to the surface of the developing roller 414, and thus the toner 43G is conveyed by utilizing the rotation of the developing roller 414. In this case, since part of the toner 43G which has been adhered to the surface of the developing roller 414 is removed by the developing blade 417, a thickness of the toner 43G which has been adhered to the surface of the developing roller 414 is uniformly leveled.

When the photosensitive drum 411 rotates while being pressed against the developing roller 414, the toner 43G which has been adhered to the surface of the developing roller 414 is transferred to the surface of the photosensitive drum 411, and thus a gold toner image is formed on the surface of the photosensitive drum 411.

In detail, since a bias voltage is applied between the photosensitive drum 411 (conductive supporting body) and the developing roller 414, a line of electric force (electric field) due to the electrostatic latent image occurs between the photosensitive drum 411 and the developing roller 414. Accordingly, the toner 43G charged with electricity on the surface of the developing roller 414 adheres to a portion, on which the electrostatic latent image is formed, on the surface of the photosensitive drum 411, by the electrostatic force. Accordingly, the portion on which the electrostatic latent image is formed is developed on the surface of the photosensitive 411, and thus the gold toner image is formed on the surface of the photosensitive drum 411.

(Primary Transfer Processing)

In the transfer portion 30, when the driving roller 32 rotates, the driven roller 33 and the backup roller 34 rotate in accordance with the rotation of the driving roller 32. The intermediate transfer belt 31 accordingly moves in a direction indicated by an arrow F5.

In the primary transfer processing, a voltage is applied to the primary transfer roller 35G. This voltage, for example, is supplied from the high-voltage power source to the primary transfer roller 35G. Since the primary transfer roller 35G is pressed against the photosensitive drum 411 through the intermediate transfer belt 31, the gold toner image which has been formed on the surface of the photosensitive drum 411 in the developing processing described above is transferred onto the surface of the intermediate transfer belt 31.

Then, the intermediate transfer belt 31 onto which the gold toner image has been transferred continuously moves in the direction indicated by the arrow F5. Thus, by the developing units 40Y, 40M, 40C, and 40K and the primary transfer rollers 35Y, 35M, 35C, and 35K, the developing processing and the primary transfer processing are performed in order by following procedures which are the same as those by the developing unit 40G and the primary transfer roller 35G described above. Therefore, the respective color toner images are successively transferred onto the surface of the intermediate transfer belt 31.

That is to say, the yellow toner image is transferred onto the surface of the intermediate transfer belt 31 by the developing unit 40Y and the primary transfer roller 35Y. Then, the red toner image is transferred onto the surface of the intermediate transfer belt 31 by the developing unit 40M and the primary transfer roller 35M. Then, the blue toner image is transferred onto the surface of the intermediate transfer belt 31 by the developing unit 40C and the primary transfer roller 35C. Then, the black toner image is transferred onto the surface of the intermediate transfer belt 31 by the developing unit 40K and the primary transfer roller 35K.

It is determined whether or not the developing processing and the transferring processing are actually performed in each of the developing units 40G, 40Y, 40M, 40C, and 40K and each of the primary transfer rollers 35G, 35Y, 35M, 35C, and 35K, depending on the colors (kinds of toners) necessary for forming the images.

(Secondary Transfer Processing)

The medium M which is conveyed along the conveyance path R1 passes through between the backup roller 34 and the secondary transfer roller 36.

In the secondary transfer processing, a voltage is applied to the secondary transfer roller 36. This voltage, for example, is supplied from the high-voltage power source to the secondary transfer roller 36. Since the secondary transfer roller 36 is pressed against the backup roller 34 through the medium M, the toner image which has been transferred onto the surface of the intermediate transfer belt 31 in the primary transfer processing described above is transferred onto the surface of the medium M.

(Fixing Processing)

The medium M onto which the toner image has been transferred in the secondary transfer processing is continuously conveyed in the direction indicated by the arrow F1 along the conveyance path R1, and thus the medium M reaches the fixing portion 50.

In the fixing processing, the surface temperature of the heating roller 51 is controlled so as to be a predetermined temperature by using the heater 53. When the pressure roller 52 rotates in a state in which the pressure roller 52 is pressed against the heating roller 51, the medium M is conveyed so as to pass through between the heating roller 51 and the pressure roller 52.

Accordingly, the toner image which has been transferred onto the surface of the medium M is heated by the heating roller 51, and thus the toner image is melted. Moreover, the toner image in the melted state is pressed against the medium M by the pressure roller 52, and thus the toner image is fixed to the surface of the medium M.

The medium M onto which the toner image has been fixed is conveyed in a direction indicated by an arrow F2 by the conveyance roller 73 along the conveyance path R2, and thus the medium M is sent to the stacker portion 11.

For example, when the image is formed on the both sides of the medium M, the medium M which has passed through the fixing portion 50 is conveyed in directions indicated by arrows F3 and F4 by the conveyance rollers 74 to 77 along the conveyance paths R3 to R5, and then the medium M is conveyed in the direction indicated by the arrow F1 again by the conveyance rollers 71 and 72 along the conveyance path R1. In this case, the direction in which the medium M is conveyed is controlled by the conveyance path switching guides 81 and 82. Thus, the primary transfer processing, the secondary transfer processing, and the fixing processing are also performed on the back surface of the medium M (the surface on which no image is yet formed).

Moreover, likewise, for example, when the image is formed multiple times on one side (for example, front surface) of the medium M, the medium M which has passed through the fixing portion 50 is conveyed in the directions indicated by the arrows F3 and F4 by the conveyance rollers 74 to 76 along the conveyance paths R3 and R5, and then the medium M is conveyed in the direction indicated by the arrow F1 again by the conveyance rollers 71 and 72 along the conveyance path R1. In this case, the direction in which the medium M is conveyed is controlled by the conveyance path switching guides 81 and 82. Then, the primary transfer processing, the secondary transfer processing, and the fixing processing are performed again on the front surface of the medium M (the surface on which the image has been already formed).

(Cleaning Processing)

In the developing unit 40G, there is a case where unnecessary remaining toner 43G remains on the surface of the photosensitive drum 411. The unnecessary remaining toner 43G, for example, is part of the toner 43G used in the primary transfer processing, and is the toner 43G which remains on the surface of the photosensitive drum 411 without being transferred onto the surface of the intermediate transfer belt 31.

When the photosensitive drum 411 rotates in a state of being pressed against the cleaning blade 415, the remaining toner 43G remaining on the surface of the photosensitive drum 411 is scraped by the cleaning blade 415. Thus, the unnecessary remaining toner 43G is removed from the surface of the photosensitive drum 411.

The cleaning processing by the cleaning blade 415 is similarly performed in the developing units 40Y, 40M, 40C, and 40K.

Moreover, there is a case where part of the toner 43G which has been transferred to the surface of the intermediate transfer belt 31 in the primary transfer processing remains on the surface of the intermediate transfer belt 31 without being transferred to the surface of the medium M in the secondary transfer processing.

However, the remaining toner 43G remaining on the surface of the intermediate transfer belt 31 is scraped by the cleaning blade 37 when the intermediate transfer belt 31 moves in the direction indicated by the arrow F5. Thus, the unnecessary remaining toner 43G is removed from the surface of the intermediate transfer belt 31.

In the cleaning processing by the cleaning blade 37, not only the remaining toner 43G remaining on the surface of the intermediate transfer belt 31, but also remaining toners 43Y, 43M, 43C, and 43K remaining on the surface of the intermediate transfer belt 31 are similarly removed.

<2-5. Function and Effect>

According to the image forming apparatus 1, the toner 43G stored in the toner cartridge 42 in the developing unit 40G has the constitution described above. Therefore, since the image quality of the brilliant image formed on the surface of the medium M is improved, the excellent brilliant image can be obtained. The function and the effect other than this are the same as those of the toner in the embodiment of the present invention.

Moreover, in the image forming apparatus 1 described above, the five developing units 40 (400, 40Y, 40M, 40C, and 40K) are provided. However, the number of developing units 40 can be arbitrarily changed. In this case, the colors of the toners used for forming brilliant images are not limited to the five colors, i.e., gold, yellow, red, blue and black, and the colors can be changed to a combination of arbitrary colors.

Furthermore, the developing unit 40G for storing the gold toner 43G, the developing unit 40Y for storing the yellow toner 43Y, the developing unit 40M for storing the red toner 43M, the developing unit 40C for storing the blue toner 43C, and the developing unit 40K for storing the black toner 43K are arranged in this order from the upstream side to the downstream side in the direction of movement of the intermediate transfer belt 31. However, the order of arrangement of the developing units 40G, 40Y, 40M, 40C, and 40K can be arbitrarily changed.

EXAMPLES

Examples of the toner in the embodiment of the present invention will now be described in detail.

<3. Manufacture of Toner>

Experimental Examples 1 to 21

In order to form gold brilliant images, the toner was manufactured by using the dissolution suspension method and by following a procedure described below.

<3-1. Preparation of Oil Phase>

In the case of preparing an oil phase, first, 58.39 pts·wt. (parts by weight) of an organic solvent (ethyl acetate) and 0.11 pts·wt. of a polymeric dispersion agent having a basic functional group (Solsperse 39000 manufactured by Lubrizol Japan Limited) were mixed with each other to solve the polymeric dispersion agent in the organic solvent. Accordingly, a dispersion agent solution was obtained.

Then, 58.5 pts·wt. of the dispersion agent solution and 6.5 pts·wt. of a brilliant pigment (aluminum powder) were mixed with each other to disperse the brilliant pigment into the dispersion agent solution. Accordingly, a brilliant dispersion liquid was obtained. In the dispersion process, a batch type ready mill dispersing machine manufactured by PRIMIX Corporation and zirconia beads were used, and a bead diameter was 0.3 mm and a bead filling rate was 55%. In this case, pre-dispersion processing (for 5 minutes) was performed at the dispersion speed of 1.2 m/s, and then main dispersion processing (for 10 minutes) was performed at the dispersion speed of 3.8 m/s.

Then, after the brilliant dispersion liquid was heated (50° C.) while being stirred, a reddish-orange fluorescent coloring matter (SINLOIHI Color FM-34N manufactured by SINLOIHI CO., LTD.), a yellow fluorescent coloring matter (SINLOIHI Color FM-35N manufactured by SINLOIHI CO., LTD.), and a binder resin (polyester) were mixed, and a resultant mixture was stirred until solid contents are dissolved. Accordingly, a brilliant-coloring-matter-containing liquid was obtained.

Finally, the brilliant-coloring-matter-containing liquid, the organic solvent (ethyl acetate) which was heated (50° C.) in advance, a releasing agent (paraffin wax), and a charge control agent (FCA-726N manufactured by Fujikura Kasei Co., Ltd.) were mixed. Mixture ratios (parts by weight) among the brilliant-coloring-matter-containing liquid (B.L.), the reddish-orange fluorescent coloring matter (R.C.), the yellow fluorescent coloring matter (Y.C.), the binder resin (B.R.), the organic solvent, the releasing agent (O.S.), and the charge control agent (C.C.) are shown in table form in FIG. 7.

Thus, the oil phase containing one kind of brilliant pigment (B.P.), two kinds of coloring matters (the reddish-orange fluorescent coloring matter and the yellow fluorescent coloring matter), the binder resin, the releasing agent, and the charge control agent was obtained.

<3-2. Preparation of Water Phase>

In the case of preparing a water phase, first, 82.16 pts·wt. of an aqueous medium (pure water) and 2.79 pts·wt. of industrial trisodium phosphate dodecahydrate were mixed with each other, a resultant mixture was then heated (60° C.), and the industrial trisodium phosphate dodecahydrate was dissolved in the aqueous medium. Accordingly, a sodium-containing aqueous solution was obtained. Then, dilute nitric acid for pH adjustment was added to the sodium-containing aqueous solution.

Meanwhile, 13.69 pts·wt. of an aqueous medium (pure water) and 1.35 pts·wt. of industrial calcium chloride anhydride were mixed with each other to dissolve the industrial calcium chloride anhydride in the aqueous medium. Accordingly, a calcium-containing aqueous solution was obtained.

Then, the sodium-containing aqueous solution and the calcium-containing aqueous solution were mixed, and then a resultant mixture was stirred. In the stirring process, a NEO MIXER manufactured by PRIMIX Corporation was used. In this case, the stirring processing (for 34 minutes) was performed at a rotational speed of 4300 rpm while the temperature of the resultant mixture was maintained at a high temperature (60° C.).

Thus, the water phase containing the aqueous medium and the inorganic dispersion agent (tricalcium phosphate) was obtained.

<3-3. Granulation>

In the case of granulation by using the oil phase and the water phase, first, the water phase was mixed with the oil phase, and then a resultant mixture was stirred. In this case, a mixture ratio (weight ratio) between the water phase and the oil phase was set as (the water phase):(the oil phase)=3:1.

In the stirring process, a line mill was used, and the stirring processing (for 5 minutes) were performed at a rotational speed of 1000 rpm. Accordingly, the resultant mixed phase was suspended and granulated, and thus a slurry containing precursor particles was obtained.

Then, the slurry was distillated at a reduced pressure. Accordingly, the organic medium (ethyl acetate) was volatized and removed. Then, by adding a pH regulator (nitric acid) to the slurry, pH value of the slurry was adjusted to be 1.5 or less. Accordingly, the inorganic dispersion agent (tricalcium phosphate) was dissolved and removed. Then, the slurry was dehydrated to collect the precursor particles. Then, the precursor particles were re-dispersed into the pure water, and then the pure water was stirred. Then, the precursor particles were dehydrated and dried, and then the precursor particles were classified.

Finally, 100 pts·wt. of the precursor particles and 1.8 pts·wt. of hydrophobic particles were mixed with each other, and then a resultant mixture was stirred. As the hydrophobic particles, a mixture of 1 pts·wt. of hydrophobic silica RX50 (average primary particle size=40 nm) manufactured by NIPPON AEROSIL CO., LTD. and 0.8 pts·wt. of hydrophobic silica RX200 (average primary particle size=12 nm) manufactured by NIPPON AEROSIL CO., LTD. was used. In the stirring process, a Henschel Mixer (capacity of 10 liters) manufactured by NIPPON COKE & ENGINEERING CO., LTD. was used, and the stirring processing (for 10 minutes) was performed at a rotational speed of 5400 rpm.

Accordingly, the hydrophobic particles were externally added to the precursor particles, and thus the toner was obtained.

Experimental Example 22

For comparison, the toner was manufactured by following the same procedure except that a magenta pigment dispersion liquid (C.I. pigment red 122 manufactured by Fuji Pigment Co., Ltd.) and a yellow pigment dispersion liquid (C.I. pigment yellow 180 manufactured by Clariant (Japan) K.K.) were used instead of the reddish-orange fluorescent coloring matter and the yellow fluorescent coloring matter.

<4. Evaluation of Brilliant Image>

A gold brilliant image was formed on the surface of the medium by using the toner described above, and the brilliant image was evaluated.

<4-1. Image Quality>

First, a brilliant image was formed on a surface of a medium by using the image forming apparatus in which the toner described above was mounted, and then the image quality of the brilliant image was judged by visual inspection. The results shown in FIG. 8 were obtained.

When the brilliant image was formed by using the image forming apparatus, a Color LED Printer C711dn manufactured by Oki Data Corporation was used as the image forming apparatus. Moreover, color copy (basis weight: 160 g/cm$^3$), wood-free paper manufactured by Fuji Xerox Co., Ltd., was used as the medium on which the brilliant image was to be formed. In this case, a solid image was formed on the surface of the medium so that the amount of toner adhering to the surface of the medium became 0.5 mg/cm$^2$.

When the image quality of the brilliant image was judged, a case where the brilliant pigment did not aggregate in the toner and sufficient and even brilliance could be obtained was judged as "good". On the other hand, a case where the brilliant pigment aggregated in the toner and no sufficient brilliance could be obtained and the brilliance was uneven was judged as "bad".

<4-2. Color Tone>

Figure 6:
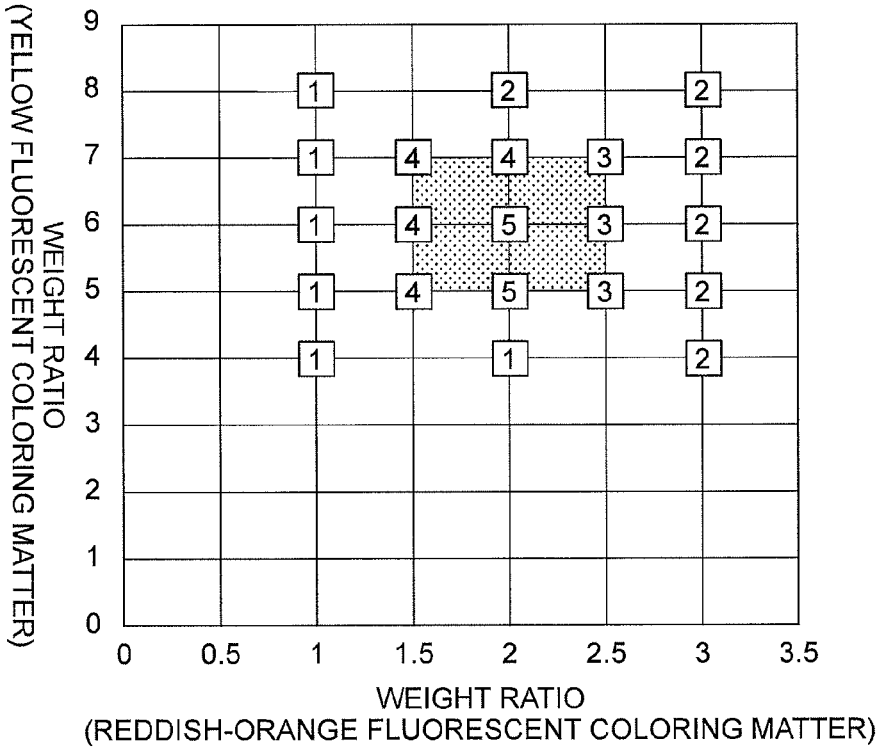
FIG. 6 is a diagram illustrating results of evaluation of color tones in relation to gold brilliant images.

By further visual checking a brilliant image of which the image quality was judged as "good" and evaluating the color tone of the brilliant image in five grades, the results shown in FIG. 8 and FIG. 6 were obtained. FIG. 6 shows the results of evaluation of the color tone of the gold brilliant image. Numerals written inside boxes shown in FIG. 6 represent the results of the evaluation in five grades which will be described below.

For evaluating the color tone in five grades, a case of bright gold color was determined as "5", a case of normal gold color was determined as "4", a case of orangish gold color was determined as "3", a case of gold color in which the color tones of red color and yellow color were strong was determined as "2", and a case of gold color in which the color tones of red color and yellow color were weak was determined as "1". In the five-grade evaluation, the evaluation result of grade 3 or more is regarded as an allowable level for practical use.

Each weight ratio of a reddish-orange fluorescent coloring matter (R.C.), a yellow fluorescent coloring matter (Y.C.), a reddish-orange pigment (R.P.) and a yellow pigment (Y.P.) shown in FIG. 8 in table form is a weight ratio to the brilliant pigment (B.P.) when the weight of the brilliant pigment is 10. The content of the brilliant pigment in the toner was 17 wt %.

<4-3. Consideration of Evaluation Result>

The result of evaluation of brilliant images greatly varied depending on the composition of the toner.

In detail, in the case where the toner contained the brilliant pigment, if the toner contained pigments (a reddish-orange pigment and a yellow pigment) as the coloring materials (Experimental Example 22), the brilliant pigment aggregated and good image quality could not be obtained. On the other hand, in the case where the toner contained the brilliant pigment, if the toner contained the coloring matters (the reddish-orange fluorescent coloring matter and the yellow fluorescent coloring matter) as the coloring materials (Experimental Examples 1 to 21), the brilliant pigment did not aggregate and good image quality could be obtained.

Moreover, in the case where good image quality was obtained (Experimental Examples 1 to 21), when the weight ratio of the reddish-orange fluorescent coloring matter was in the range of 1.5 to 2.5 and the weight ratio of the yellow fluorescent coloring matter was in the range of 5 to 7, the color tone of an allowable level for practical use (evaluation result of grade 3 or better) was obtained. In FIG. 6, the range in which the weight ratio of the reddish-orange fluorescent coloring matter is in the range of 1.5 to 2.5 and the weight ratio of the yellow fluorescent coloring matter is in the range of 5 to 7 is indicated by hatching.

In this case, in particular, when the weight ratio of the reddish-orange fluorescent coloring matter is in the range of 1.5 to 2 and the weight ratio of the yellow fluorescent coloring matter is in the range of 5 to 6, the color tone was further improved.

The results shown in FIG. 8 and FIG. 6 indicate that in the case where the toner contained the brilliant pigment, when the toner contained the coloring matter as the coloring material, the image quality and the color tone of the brilliant image were improved. Therefore, the excellent brilliant image was obtained.

Although the present invention is thus described by giving the embodiment and specific examples, the present invention is not limited to the aspects described in the embodiment and the specific examples and various modification can be made.

For example, the toner of the present invention is not limited to the use in the intermediate transfer type image forming apparatus which uses the intermediate transfer belt, and it may be used in an image forming apparatus other than the intermediate transfer type image forming apparatus. Moreover, for example, a use of the toner of the present invention is not limited to the use in the electrophotographic image forming apparatus, and it may be used in an image forming apparatus other than the electrophotographic image forming apparatus. Furthermore, a use of the toner of the present invention is not limited to the use in the image forming apparatus, and it may be used in any other apparatus other than the image forming apparatus.

What is claimed is:

1. A gold toner comprising:

one or more kinds of brilliant pigments; and one or more kinds of coloring matters including a reddish-orange fluorescent coloring matter and a yellow fluorescent coloring matter, wherein:

a content of the one or more kinds of brilliant pigments in the gold toner is not less than 15 wt % and not more than 20 wt %;

a ratio of a weight of the reddish-orange fluorescent coloring matter to a weight of the one or more kinds of brilliant pigments is not less than 1.5 and not more than 2.0 when the weight of the one or more kinds of brilliant pigments is 10; and a ratio of a weight of the yellow fluorescent coloring matter to the weight of the one or more kinds of brilliant pigments is not less than 5 and not more than 6 when the weight of the one or more kinds of brilliant pigments is 10.

2. The gold toner according to claim 1, further comprising:

a binder resin;

an organic solvent;

an inorganic dispersion agent; and an aqueous medium; wherein:

a granulated substance is formed by mixing an oil phase and a water phase, the oil phase containing the one or more kinds of brilliant pigments, the one or more kinds of coloring matters, the binder resin, and the organic solvent, and the water phase containing the inorganic dispersion agent and the aqueous medium.

3. The gold toner according to claim 2, wherein the granulated substance is formed by a dissolution suspension method.

4. The gold toner according to claim 1, wherein the one or more kinds of brilliant pigments contain at least one of aluminum and a pearl pigment.

5. A toner cartridge, comprising:

a gold toner; and a storing portion that stores the gold toner; wherein the gold toner includes:

one or more kinds of brilliant pigments; and one or more kinds of coloring matters including a reddish-orange fluorescent coloring matter and a yellow fluorescent coloring matter, wherein:

a content of the one or more kinds of brilliant pigments in the gold toner is not less than 15 wt % and not more than 20 wt %;

a ratio of a weight of the reddish-orange fluorescent coloring matter to a weight of the one or more kinds of brilliant pigments is not less than 1.5 and not more than 2.0 when the weight of the one or more kinds of brilliant pigments is 10; and a ratio of a weight of the yellow fluorescent coloring matter to the weight of the one or more kinds of brilliant pigments is not less than 5 and not more than 6 when the weight of the one or more kinds of brilliant pigments is 10.

6. A developing unit comprising:

a storing portion that stores gold toner; and a developing portion that performs developing processing by using the gold toner stored in the storing portion, wherein:

the gold toner includes:

one or more kinds of brilliant pigments; and one or more kinds of coloring matters including a reddish-orange fluorescent coloring matter and a yellow fluorescent coloring matter, wherein:

a content of the one or more kinds of brilliant pigments in the gold toner is not less than 15 wt % and not more than 20 wt %;

a ratio of a weight of the reddish-orange fluorescent coloring matter to a weight of the one or more kinds of brilliant pigments is not less than 1.5 and not more than 2.0 when the weight of the one or more kinds of brilliant pigments is 10; and a ratio of a weight of the yellow fluorescent coloring matter to the weight of the one or more kinds of brilliant pigments is not less than 5 and not more than 6 when the weight of the one or more kinds of brilliant pigments is 10.

7. An image forming apparatus, comprising:

a storing portion that stores gold toner;

a developing portion that performs developing processing by using the gold toner stored in the storing portion; and a transfer portion that performs transfer processing by using the gold toner used in the developing processing; wherein the gold toner includes:

one or more kinds of brilliant pigments; and one or more kinds of coloring matters including a reddish-orange fluorescent coloring matter and a yellow fluorescent coloring matter, wherein:

a content of the one or more kinds of brilliant pigments in the gold toner is not less than 15 wt % and not more than 20 wt %;

a ratio of a weight of the reddish-orange fluorescent coloring matter to a weight of the one or more kinds of brilliant pigments is not less than 1.5 and not more than 2.0 when the weight of the one or more kinds of brilliant pigments is 10; and a ratio of a weight of the yellow fluorescent coloring matter to the weight of the one or more kinds of brilliant pigments is not less than 5 and not more than 6 when the weight of the one or more kinds of brilliant pigments is 10.

* * * * *